United States Patent [19]

Dong

[11] Patent Number: 4,659,128

[45] Date of Patent: Apr. 21, 1987

[54] MANIPULATION HOLDER FOR CHOPSTICKS

[76] Inventor: Seung G. Dong, 8109 W. Broad St., Richmond, Va. 23229

[21] Appl. No.: 851,542

[22] Filed: Apr. 14, 1986

[51] Int. Cl.[4] ..... A47G 21/10; A47J 43/28

[52] U.S. Cl. ..... 294/99.2

[58] Field of Search ..... 294/3, 8.5, 11, 16, 294/25, 33, 99.1, 99.2, 103.1, 104, 106; D7/105; 30/135, 142, 150

[56] References Cited

U.S. PATENT DOCUMENTS

| | | | |
|---|---|---|---|
| D. 233,398 | 10/1974 | Lee | 294/99.2 X |
| 448,155 | 3/1891 | Merrill | 294/99.2 |
| 1,723,597 | 8/1929 | Bannister | 294/99.2 X |
| 2,612,401 | 9/1952 | Simmonds | 294/33 X |
| 2,711,339 | 6/1955 | McGogy | 294/99.2 |
| 2,943,521 | 7/1960 | Betton | 294/99.2 |
| 3,186,749 | 6/1965 | Dawes | 294/99.2 |
| 3,239,262 | 3/1966 | Rines et al. | 294/99.2 |
| 3,501,191 | 3/1970 | Darr | 294/99.2 |
| 4,199,180 | 4/1980 | Kelly | 294/99.2 X |

FOREIGN PATENT DOCUMENTS

| | | | |
|---|---|---|---|
| 402191 | 9/1909 | France | 294/99.2 |
| 177367 | 3/1922 | United Kingdom | 294/11 |

*Primary Examiner*—Johnny D. Cherry

*Attorney, Agent, or Firm*—Norman B. Rainer

[57] ABSTRACT

A device is provided for removably holding chopsticks of conventional design. The device causes the chopsticks to be easier to manipulate, and facilitates learning of the proper use of chopsticks. The device is constructed of two compliant holding tubes bridged by an upper restraining member and a lower resilient member. An advertising plate may be attached to the device on either or both sides.

10 Claims, 4 Drawing Figures

MANIPULATION HOLDER FOR CHOPSTICKS

BACKGROUND OF THE INVENTION

This invention relates to chopsticks, and more particularly concerns a device which holds a pair of chopsticks to facilitate their manipulation.

A chopstick is an elongated rigid utensil having a thick upper extremity and tapering to a narrower lowermost extremity. When a pair of the chopsticks are hand-held at their upper extremities, the lowermost extremities may be manipulated to grip food and lift it to the diner's mouth. Because they are essentially two disconnected sticks, a certain degree of skill is required to manipulate the chopsticks properly. For this reason, most people of the Western world have never used chopsticks except on rare occasions as a lark.

In order to make chopsticks more acceptable to those persons not trained from childhood in their use, numerous modifications have been proposed in chopsticks.

The upper portions of chopsticks have been coupled by resilient means such as springs as disclosed in U.S. Pat. Nos. 3,937,510; D-277,446; 3,323,825; 3,239,262; 3,501,191; 3,637,248; and 4,199,180. Such spring coupling technique helps maintain the chopsticks in coplanar juxtaposition, permitting the lowermost extremities to be brought together by pivotal motion of the sticks about the spring. However, the spring means itself still permits misalignment of the sticks away from coplanarity by rotation about the axis of the spring. To restrain such rotational movement about a coupling spring in tong-like utensils, U.S. Pat. No. 1,723,597 discloses a second coupling affixed between the elongated members above the spring. However, such constructions are costly and not intended as single use disposable utensils. The aforesaid innovations generally limit the versatility of chopsticks because they cannot fulfill the needs of both beginners and experienced users. Furthermore, prior modifications of chopsticks generally alter the natural motion of the chopsticks, and therefore are poorly suited for training individuals in the use of unmodified chopsticks.

It is accordingly an object of the present invention to provide a holder which will easily engage and disengage a pair of chopsticks.

It is another object of this invention to provide a holder as in the foregoing object which simplifies the manipulation of chopsticks in the gripping and handling of food, and serves as a training aid for the use of unmodified chopsticks.

It is a further object of the present invention to provide a holder of the aforesaid nature which causes the chopsticks to be spanned by resilient means and by means to minimize rotation about said resilient means.

It is still another object of this invention to provide a holder of the aforesaid nature amenable to attachment of advertising indicia and amenable to low cost manufacture.

These objects and other objects and advantages of the invention will be apparent from the following description.

SUMMARY OF THE INVENTION

The above and other beneficial objects and advantages are accomplished in accordance with the present invention by a holder comprising two elongated holding tubes of circular cylindrical internal configuration disposed in substantially parallel relationship and having upper and lower open extremities, a resilient member spanning said tubes in operative association therewith adjacent said lower extremities, and a restraining member spanning said tubes in operative association therewith adjacent said upper extremities.

The holding tubes are preferably of identical size and shape, having a circular cylindrical interior cross sectional configuration. The holding tubes are preferably of a compliant nature, having the ability to securely adapt to and hold the upper extremities of chopsticks of various cross-sectional contour. The holding tubes are most suitably fabricated of thin-walled plastic material such as polyethylene as in the general construction of drinking straws.

The resilient spanning member is preferably a tube of thin walled polyethylene having a crimped, bellows-like construction, as is sometimes used on drinking straws adapted to bend to substantially right angles about the rim of a glass.

The present invention further contemplates the combination of a pair of conventional chopsticks in functional engagement with the holder device.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENTS

Figure 1:
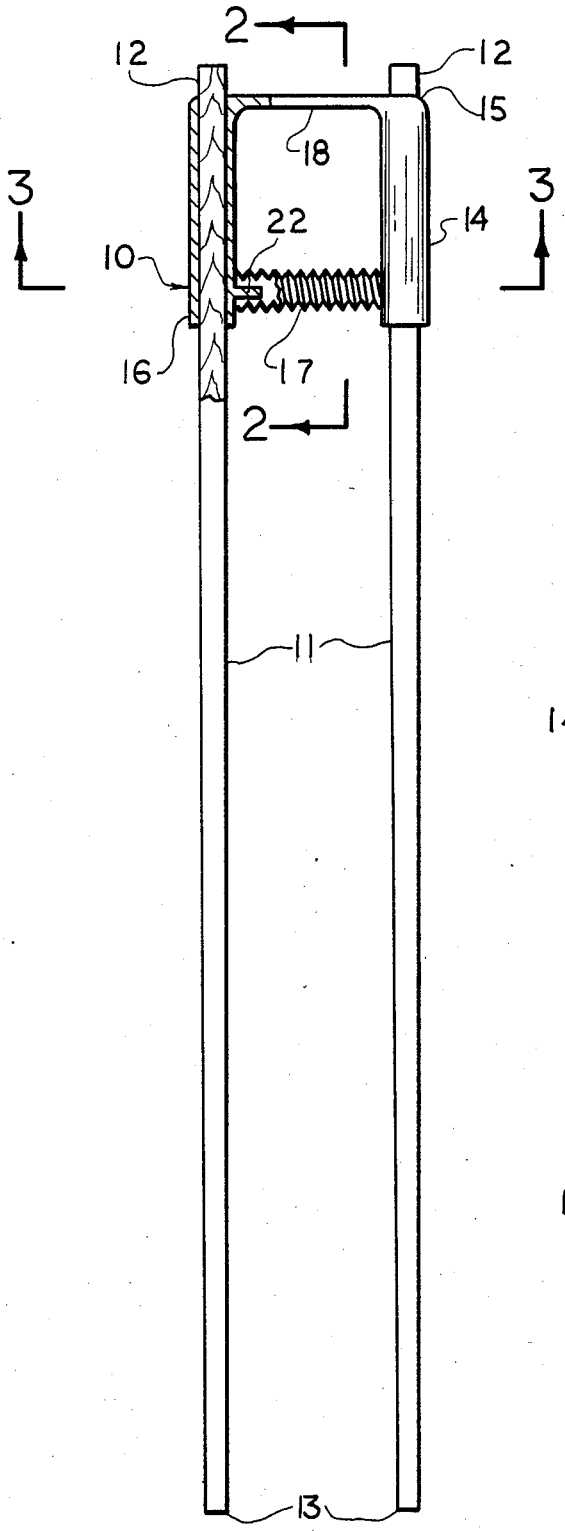
FIG. 1 is a front view of an embodiment of the holder of this invention with portions broken away and shown in operative association with a pair of chopsticks.
Figure 2:
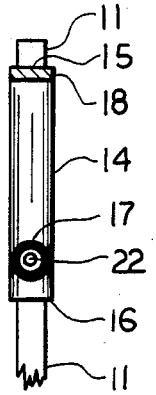
FIG. 2 is an enlarged sectional view taken along the line 2—2 of FIG. 1.
Figure 3:
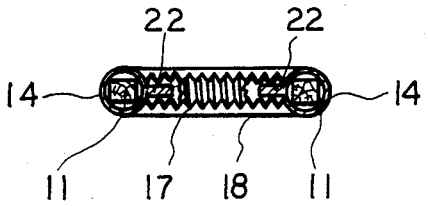
FIG. 3 is an enlarged sectional view taken along the line 3—3 of FIG. 1.

Referring to FIG. 1 of the drawing, an embodiment of the combination of chopsticks and holder of this invention is shown comprised of holder 10 and paired chopsticks 11 of substantially square cross-sectional configuration tapering from a thick top extremity 12 to a considerably narrower bottom extremity 13.

The holder is comprised of two identical holding tubes 14 having open upper and lower extremities 15 and 16, respectively, said tubes being disposed in substantially parallel relationship. A resilient member in the form of a crimped tube 17 having a bellows or accordian configuration is held by inwardly directed opposed posts 22 integral with said holding tubes adjacent the lower extremities thereof. Alternative equivalent constructions may however be utilized to cause the resilient member to engage the holding tubes. A restraining member in the form of semi-rigid tube 18 spans tubes 14 in joinder therewith adjacent upper extremities 15 and in parallel relationship to resilient member 17. The restraining member permits the tubes to move so that the lower extremities can approach one another, but such approaching movement is denied the upper extremities. The entire holder assembly may be of integral monolithic construction, fabricated of plastic by injection molding. Alternatively, the separate components may be interadhered from thin-walled tube stock of the type used for drinking straws. The holding tubes are preferably of thin-walled, radially deformable construction. The purpose for such deformability is to establish a firm grip upon chopsticks inserted within the tubes. For example, the square cross-sectioned chopsticks of the exemplified embodiment cause a conforming deformation of the tube to assure a snug fit. The resultant snug fit enables the user to adjust the effective length of the combination by inserting the chopsticks to desired extents within or through the holder tubes. It is to be noted that the longitudinal axes of the holding tubes, resilient member and restraining member are coplanar.

In use, the diner grips the chopsticks in normal manner below the holder device. The combined effects of resilient member 17 and restraining member 18 help to maintain the chopsticks in coplanar relationship. The resilient member is designed to be under slight restorative compression when the bottom extremities of the chopsticks are together.

Because the holder device can be employed with inexpensive wooden chopsticks as supplied in restaurants, and because the holder itself is designed to be of inexpensive cost, the holder and chopsticks will find extensive use as discardable items to be given away in restaurants.

Figure 4:
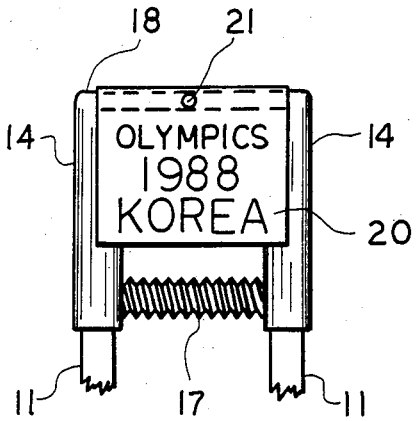
FIG. 4 is a front view of an alternative embodiment of the holder of this invention.

By virtue of the specialized construction of the holder, a plate 20, shown in FIG. 4, containing visibly distinctive advertising indicia may be readily attached to either or both sides of the holder without impairing its functionality. In the embodiment of FIG. 4, attachment means in the form of rivet 21 secure plate 20 to restraining member 18. The advertising indicia further augments the effectiveness of the disposable feature of the holder by causing it to have value as a souvenir or momento of an occasion. The plate may be of any shape, and may have any size compatible with the functionality of the holder.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A holder for chopsticks comprising two elongated compliant holding tubes of circular cylindrical internal configuration disposed in substantially parallel relationship and having upper and lower open extremities, a resilient member spanning said tubes adjacent said lower extremities and constructed to exert a force opposing movement of said lower extremities toward each other, and a semi-rigid restraining member spanning said tubes adjacent said upper extremities in parallel relationship to said resilient member and constructed to permit movement of said lower extremities toward each other while preventing such movement of said upper extremities, the longitudinal axes of said holding tubes, resilient member and restraining member being in coplanar disposition.

2. The holder of claim 1 wherein said compliant holding tubes will conform to the cross-sectional shape of a chopstick inserted therein, and thereby grips said chopstick.

3. The holder of claim 2 further comprising a plate containing visibly distinctive indicia.

4. The holder of claim 3 wherein said plate is affixed to said restraining member.

5. The holder of claim 3 wherein said resilient member is an accordian-folded thin tube.

6. The holder of claim 5 wherein said accordian-folded thin tube is held upon said holding tubes by posts affixed to said holding tubes and insertable into said accordian-folded thin tube.

7. The holder of claim 1 wherein said holding tubes and restraining member are portions of a monolithic structure fabricated of molded thermoplastic polymer.

8. The holder of claim 7 wherein said polymer is polyethylene.

9. The holder of claim 1 in combination with chopsticks operatively inserted into said holding tubes.

10. The holder of claim 9 wherein said chopsticks have an upper extremity which tapers to a thinner lower extremity, and said upper extremity engages said holding tubes.

* * * * *